US008764119B2

(12) United States Patent
Hobbs

(10) Patent No.: US 8,764,119 B2
(45) Date of Patent: Jul. 1, 2014

(54) BRUSHES

(75) Inventor: Stuart Hobbs, Norton (GB)

(73) Assignee: L G Harris & Co Limited, Worcestershire (GB)

( * ) Notice: Subject to any disclaimer, the term of this patent is extended or adjusted under 35 U.S.C. 154(b) by 1376 days.

(21) Appl. No.: 12/067,497

(22) PCT Filed: Sep. 18, 2006

(86) PCT No.: PCT/GB2006/003460

§ 371 (c)(1),
(2), (4) Date: Sep. 9, 2008

(87) PCT Pub. No.: WO2007/034156

PCT Pub. Date: Mar. 29, 2007

(65) Prior Publication Data

US 2008/0313836 A1 Dec. 25, 2008

(30) Foreign Application Priority Data

Sep. 24, 2005 (GB) ..... 0519528.4

(51) Int. Cl.
*A46B 3/04* (2006.01)

(52) U.S. Cl.
USPC ..... 300/21; 15/159.1; 15/160; 15/192

(58) Field of Classification Search
CPC ..... A46B 2200/202; A46B 5/00; A46B 3/00; A46B 3/02; A46B 3/04; A46B 3/005
USPC ..... 15/DIG. 5, 159.1, 160, 192–193; 300/21
See application file for complete search history.

(56) References Cited

U.S. PATENT DOCUMENTS

| | | | | | |
|---|---|---|---|---|---|
| 930,375 | A | * | 8/1909 | Hasoy | 15/192 |
| 2,508,931 | A | * | 5/1950 | Simms | 15/171 |
| 2,512,997 | A | | 6/1950 | Bixler | |
| 3,030,649 | A | * | 4/1962 | Karlan et al. | 15/193 |
| 3,386,119 | A | * | 6/1968 | Shulman | 15/193 |
| 3,733,638 | A | | 5/1973 | Kaplan | |
| 4,525,890 | A | | 7/1985 | Peerman et al. | |
| 4,590,637 | A | * | 5/1986 | Marino | 15/160 |
| 6,012,194 | A | * | 1/2000 | Eshbach et al. | 15/143.1 |

FOREIGN PATENT DOCUMENTS

DE 39 36 581 5/1991

OTHER PUBLICATIONS

International Search Report and Written Opinion for PCT/GB06/003460 mailed Jan. 26, 2007.

* cited by examiner

*Primary Examiner* — Laura C Guidotti
(74) *Attorney, Agent, or Firm* — Gifford, Krass, Sprinkle, Anderson & Citkowski, P.C.

(57) ABSTRACT

A paint brush (201) is provided. The brush comprises a bristle cluster (207) and a handle (202) for holding the cluster. The root end of the cluster is set into adhesive composition by a set depth X. The cluster comprises bristles of two or more different lengths. For a majority of the bristles the difference in length between a longest bristle and a shortest bristle is a range value Y. Y is less than X which means that one end of all bristles conforming to this rule must be embedded in adhesive composition but not all bristles will extend all the way to the tip end of the cluster. This ensures that bristles do not fall out of the handle while providing a tip end with reduced weight.

13 Claims, 9 Drawing Sheets

BRUSHES

RELATED APPLICATION

This application is the U.S. National Phase of PCT/GB2006/003460 filed Sep. 18, 2006, which claims priority of Great Britain Patent Application 0519528.4 filed Sep. 24, 2005.

BACKGROUND OF THE INVENTION

I. Field of the Invention

The present invention relates generally to a brush and particularly to a brush bristle cluster and its association with a brush handle. The present invention has particular, although not exclusive, utility in the field of paint brushes.

II. Description of Related Art

FIGS. 1A to 1C illustrate a known brush construction. The brush 1 shown in FIG. 1C comprises a main body portion 2 and a bristle cluster 7.

Referring first to FIG. 1A the body portion 2 has a handle portion 3 and an enlarged head portion 4 terminating with a flat abutment surface 4*a*. A metal ferrule 5 surrounds the head portion 4 and extends beyond the surface 4*a* to form a rebate 6.

Referring now to FIG. 1B the bristle cluster 7 comprises a plurality of bristles and has a tip end 8 terminating at a tip end terminus point 8*a* defining the maximum extent of the cluster tip, and a root end 9 terminating at a root end terminus point 9*a* defining the maximum extent of the cluster root.

In this example the cluster 7 comprises bristles 10 of three different lengths: the longest bristles 10*a* have a length L1; the middle length bristles 10*b* have a length L2; and the shortest bristles 10*c* have a length L3. The length L1 is 10 mm greater than the length L2 and the length L2 is 10 mm greater than the length L3. In practice, particularly where natural bristles are used, the number of different lengths of bristles may be far greater than three, but for the purposes of simplicity only three are referred to here.

Referring now also to FIG. 1C the root end 9 of the bristle cluster 7 is received in the rebate 6 and either resin (not shown) is filled into the rebate 6 or the end of the cluster 7 is first dipped into resin and then inserted into the rebate to adhere the bristle ends both together and to the ferrule 5 and the head portion 4. The root end 9 of the bristle cluster 7 is set into the resin bed by a set depth defined by the rebate 6, which in this case is 8 mm.

A setting region within which bristle ends at the root end 9 are embedded in resin therefore extends for 8 mm from the abutment surface 4*a* to the open end of the rebate 6. Bristles commencing at the point 9*a* are therefore embedded in resin to a maximum extent.

The longest bristles 10*a* commence at the point 9*a* and terminate at the point 8*a* and therefore are inserted in the setting region 11 to the maximum set depth of 8 mm. Accordingly, only bristles having a length greater than L1 minus 5 mm are guaranteed to be embedded within the resin to at least some extent. This is because shorter bristles can terminate at any point up to the tip end terminus point 8*a* of the cluster and only extend from there to commence at a point at the root end 9 as determined by their length. For example, a bristle 10*b* terminating at the tip end terminus point 8*a* would only commence 2 mm away from the start of the region 11 and would not be embedded. Bristles 10*b* and 10*c* have a length less than L1 minus 8 mm are therefore not guaranteed to be embedded within the resin; whether they are or not will depend on their longitudinal position within the cluster (i.e. where they commence and terminate relative to the points 8*a*, 9*a*).

As shown in FIG. 1C, some of the bristles 10*b*, 10*c* do not commence within the setting region 11 and are therefore not embedded in resin. These bristles may fall out of the cluster in use of the brush.

In order to attempt to prevent bristle loss of the type described in relation to FIGS. 1A to 1C the brush 101 shown in FIG. 2 was developed, The brush 101 is similar to the brush 1 shown in FIG. 1 with the exception of the bristle cluster 107. The cluster 107 comprises bristles 120 which are all approximately the same length and all commence and terminate at or close to the tip end 108*a* and root end points 109*a* respectively. In this case the set depth is 10 mm and accordingly when the root end 109 is inserted into the rebate 106 so that the point 109*a* abuts against the surface 104*a* all bristles 120 in the cluster 107 are maximally inserted into the setting region 111 and bristle loss during use is minimised.

However, because all bristles terminate at the point 108*a* it has been found that brushes using the principles of FIG. 2 can feel "tip heavy" in use when compared to brushes of the type shown in FIG. 1C, for example, in which due to the variation in bristle lengths the tip end does not include terminal segments of all bristles.

SUMMARY OF THE INVENTION

The present invention seeks to address the problems with known brushes.

According to a first aspect of the present invention there is provided a paint brush having a bristle cluster and a handle for holding the bristle cluster, one end of the bristle cluster being set into adhesive composition by a set depth X, the bristle cluster comprising bristles of two or more different lengths, in which for a majority of the bristles the difference in length between a longest bristle and a shortest bristle is a range value Y, and in which Y is less than X.

If a longest bristle is embedded to the maximum extent (i.e. it terminates at a root end terminus and extends to a tip end terminus) then bristles having a length greater than the length of the longest bristle minus the set depth are guaranteed to be embedded to at least some extent irrespective of the relative longitudinal positions of the bristles. If all bristles conform to this rule then even a shortest bristle commencing at the tip end terminus point will be embedded in a setting region to some extent at the root end, although of course it will not extend all the way to the root end terminus point.

In other words, the value for the range over which bristle lengths are spread (longest minus shortest) is less than the depth to which the bristle cluster root end is set into the body of adhesive composition.

The result is that all bristle ends of bristles confirming to the rules of the present invention must be embedded to at least some extent and therefore positively set in the handle. Furthermore, due to the inclusion of shorter bristles the number of bristles which terminate reduces towards the tip end of the bristle cluster so that the weight at the tip end is reduced.

The range value Y may apply for substantially all of the bristles in a cluster to minimise bristle drop. In some embodiments the range value Y may apply for all of the bristles in a cluster to prevent all bristle loss.

In order to ensure that the shortest bristles in a cluster are firmly embedded in a setting region, Y may be less than ½ X.

The bristle cluster may comprise bristles of only two different lengths. Accordingly the manufacture of the cluster is simplified. Furthermore, all bristles which are not the longest must be the shortest and therefore the tip end weight reduction can be minimised, as the shortest bristles are thereby more likely to terminate earlier along the length of the cluster.

In one embodiment X may be approximately 12 mm and Y may be approximately 6 mm.

The bristles may comprise synthetic and/or natural bristles. If bristle drop is to be prevented it is important that the lengths of bristles present in a cluster can be accurately specified and provided. Any bristle which does not fall within a specified range is at risk of not becoming embedded.

The bristle cluster may be resin set into the handle. Other suitable adhesive compounds may also be used.

The brush may have a ferrule for holding the bristle cluster and defining a rebate for receiving resin. Of course other arrangements for retaining bristle clusters are known and could be compatible with the present invention.

The brush may comprise a painting brush although the principles of the present invention may be applicable to other types of brush.

According to a second aspect of the present invention there is provided a brush bristle cluster for a paint brush of the type having a handle for holding the bristles in which one end of the cluster is set positively into the handle by embedding it in adhesive composition to a set depth X, the cluster comprising bristles of two or more different lengths, in which for a majority of the bristles the difference in length between a longest bristle and a shortest bristle is a range value Y, and in which Y is less than X.

According to a third aspect of the present invention there is provided a method of making a paint brush comprising the steps of:

providing a bristle cluster comprising a plurality of bristles including bristles of two or more different lengths the maximum and minimum values of which fall within a predetermined range having a spread value Y;

providing a handle for holding the bristle cluster; and setting one end of the bristle cluster into a bed of adhesive composition in the handle at a predetermined set depth X;

in which Y is selected to be less than X.

BRIEF DESCRIPTION OF THE DRAWING

The present invention will now be more particularly described, by way of example, with reference to the accompanying drawings, in which.

DETAILED DESCRIPTION OF THE INVENTION

Figure 1A:
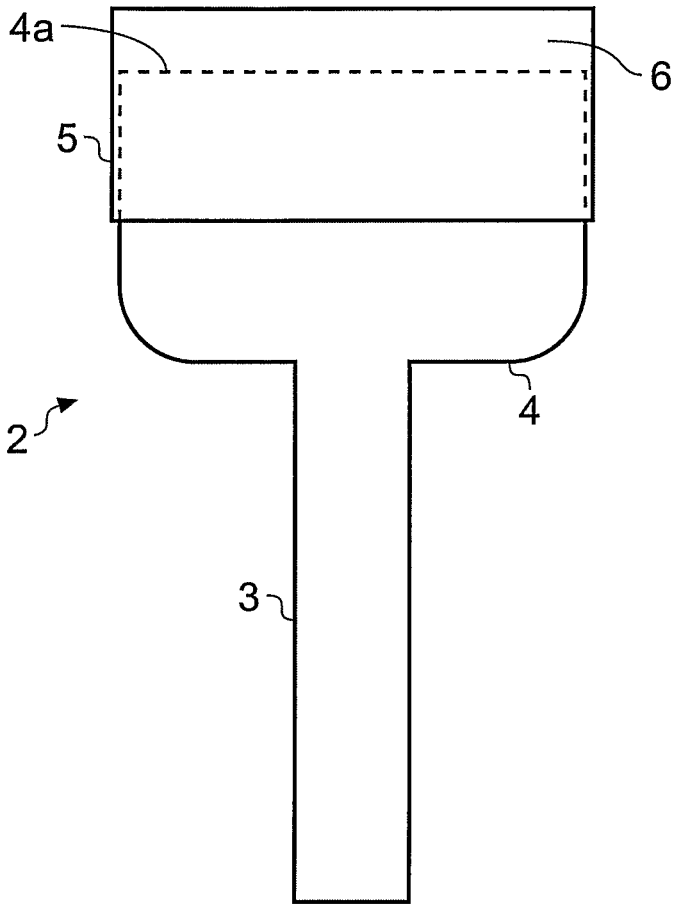
Fig. 1A (Prior Art)
FIGS. 1A to 1C illustrate a known brush construction
Figure 1B:
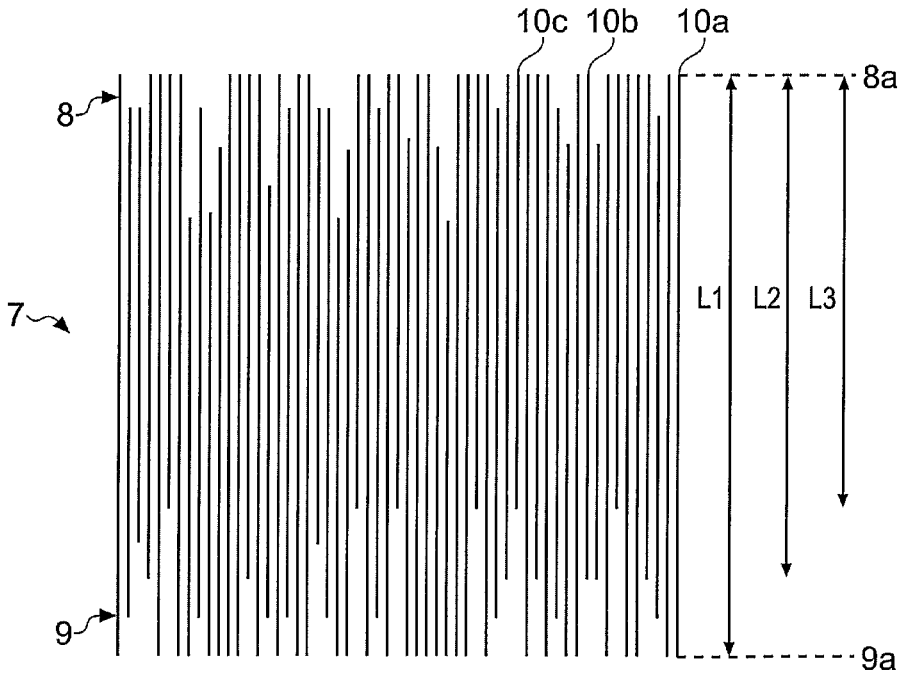
Fig. 1B (Prior Art)
Figure 1C:
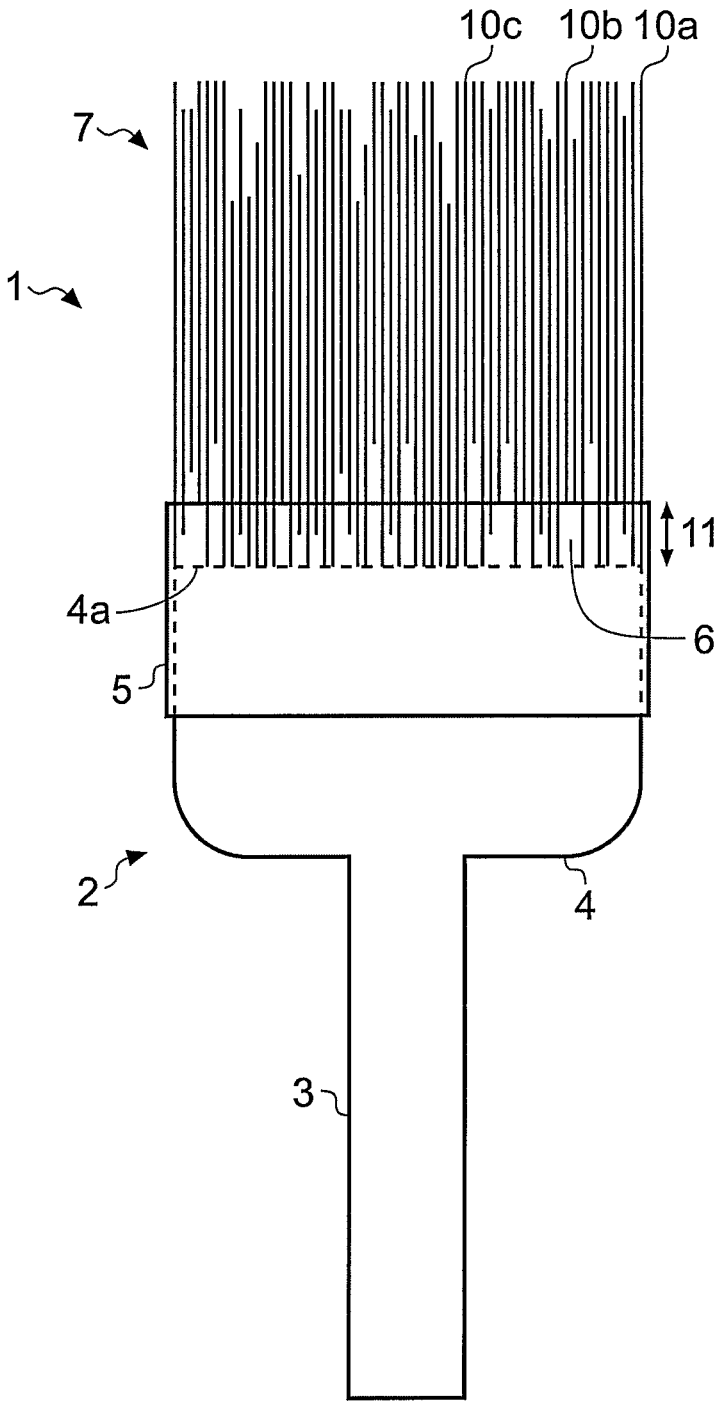
Fig. 1C (Prior Art)
Figure 2:
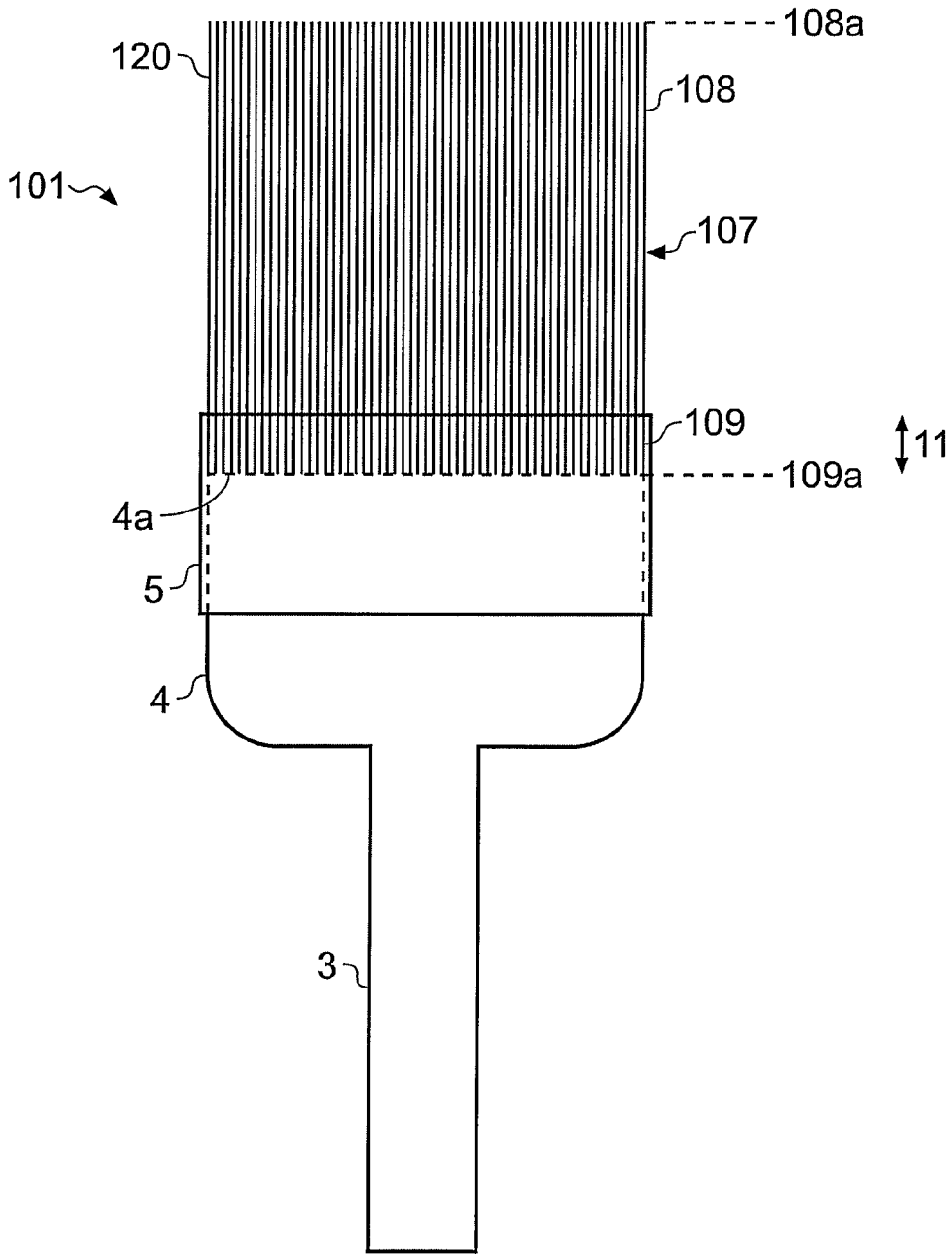
Fig. 2 (Prior Art)
FIG. 2 illustrates a known brush construction
Figure 3A:
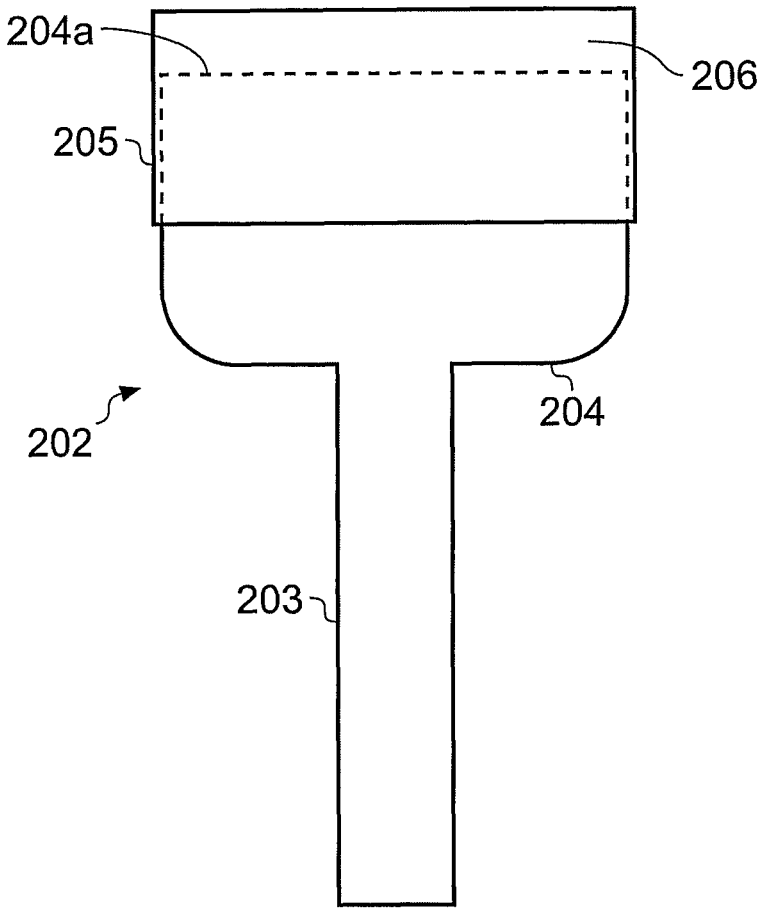
FIG. 3A is a section of a paint brush body portion formed according to the present invention.

Referring first to FIG. 3A there is shown a main body portion 202 which in this embodiment is the same as the portion 2 shown in FIG. 1A.

Figure 3B:
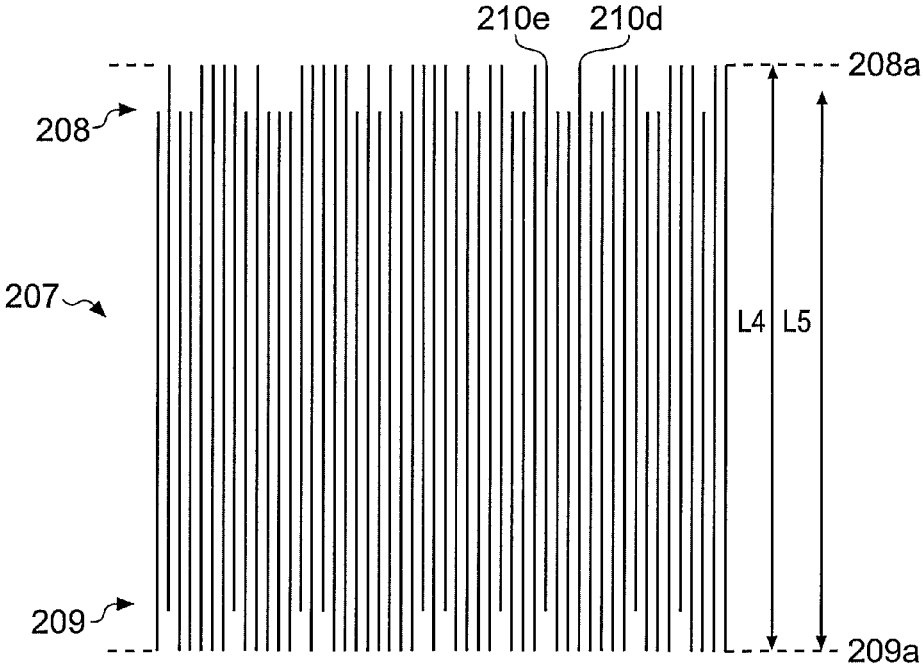
FIG. 3B is a section of a bristle cluster formed according to the present invention.

FIG. 3B shows a bristle cluster 207 comprising a plurality of bristles. In this embodiment there are only two different types of bristles 210*d*, 210*e*. The longer of the two bristles 210*d* has a length L4 and the shorter bristles 210*e* have a length L5. Therefore the range Y of bristle lengths equals L4 minus L5.

Figure 3C:
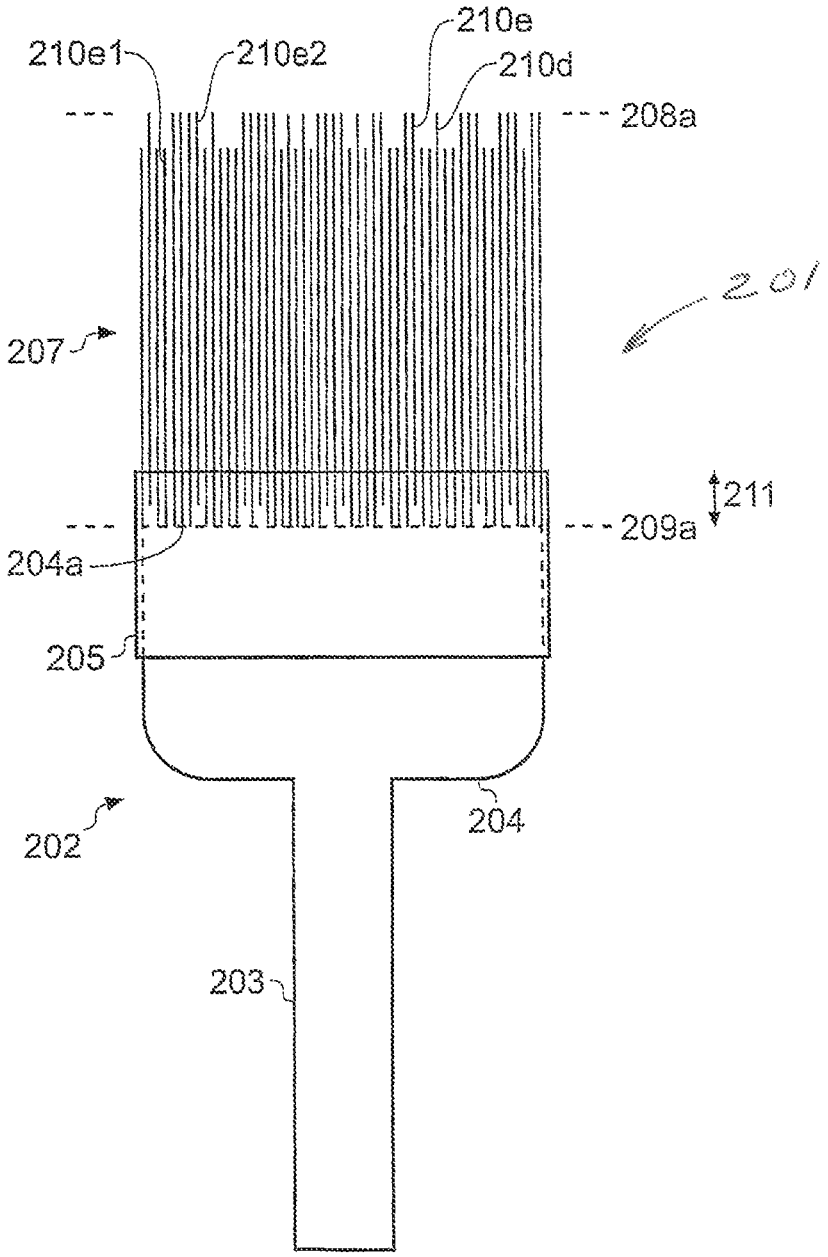
FIG. 3C is a section of a brush formed by the association of the body portion of FIG. 3A with the bristle cluster of FIG. 3B.

Referring now also to FIG. 3C the cluster 207 is shown set into the body portion 202 to form a brush 201. The brush 201 has a head portion 204, handle portion 203 and ferrule 205. The cluster 207 is embedded in an adhesive composition to a set depth X which in this embodiment is 10 mm and defines a setting region 211 in the body portion 202.

The range Y value in this embodiment is 5 mm and is therefore less than the set depth X. Accordingly, all of the longer bristles 210*d* extend from the point 209*a* to the point 208*a* and are maximally embedded into the setting region 211. Furthermore, regardless of the longitudinal position of the shorter bristles 210 within the cluster 207, they are guaranteed to be at least partly within the setting region 211. For example, the bristle labelled 210*e*1 commences at the point 209*a* and extends towards the point 208*a* but terminates at a point away from the point 208*a* by a distance equal to L4 minus L5. The bristle 210*e*1 is therefore maximally inserted into the adhesive bed and therefore the setting region 211 but does not extend all the way to the tip end of the cluster 207. In contrast, the bristle 210*e*2 terminates at the point 208*a* and commences at a distance away from the point 209*a* equal to L4 minus L5. However, because the range Y is less than the set depth X, the bristle 210*e*2 must commence within the setting region 211. Other bristles 210*e* may lie within the cluster at points intermediate the extremes of 210*e*1 and 210*e*2.

In the cluster 207 shown in FIG. 3C, therefore, all of the bristles commence within the setting region 211 but do not all extend all the way to the point 208*a*. As a result, all of the bristles are embedded in adhesive composition but the tip end 208 becomes less dense with bristles as the point 208*a* is approached.

Figure 4:
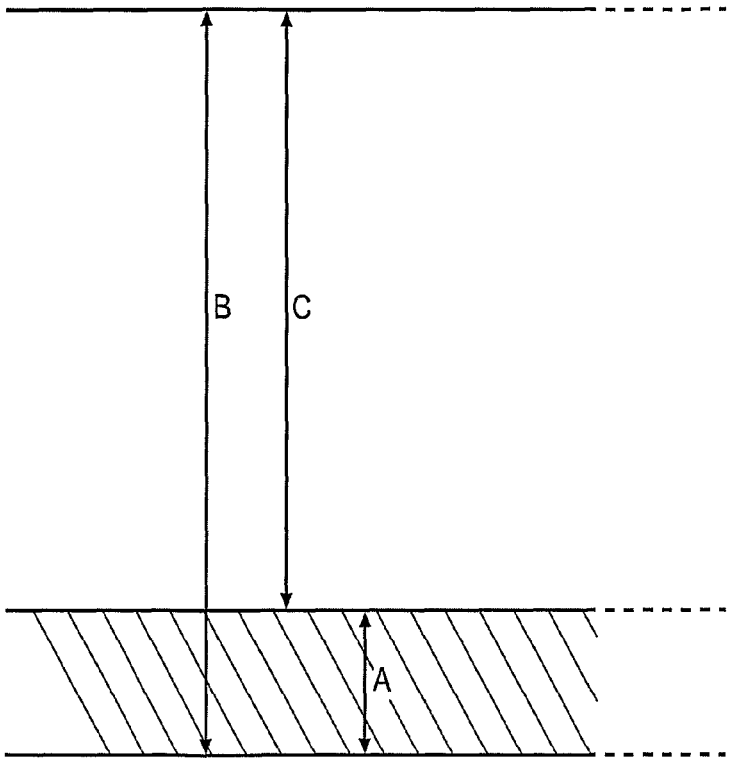
FIG. 4 is an illustration of a bristle length rule by which bristle clusters according to the present invention are formed.

Referring now to FIG. 4 the principles upon which brushes are formed according to the present invention is illustrated.

The distance to which a cluster root is set into resin is designated A (the set depth). A longest bristle length in a cluster is designated B. A distance C represents the distance between the termination of the setting region and the termination of the longest bristle. In order for bristles shorter than length B to be guaranteed to be embedded to at least some extent in the setting region, B minus C must be greater than A. In other words, the length of all bristles must be more than the distance from the tip end terminus point to the start of the setting region. If this rule is satisfied for all bristles then they must all be embedded into the setting region by at least some extent.

Figure 5:
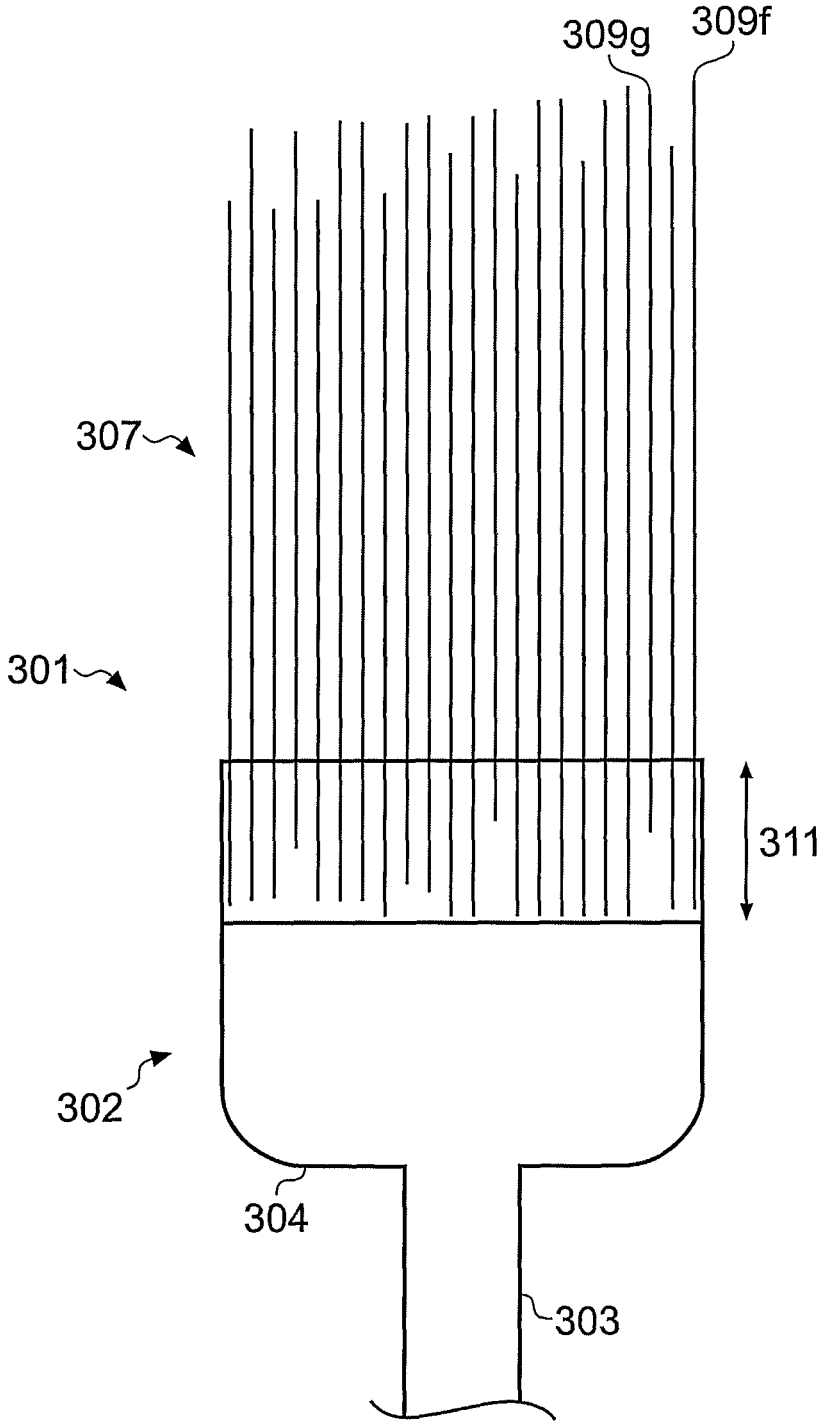
FIG. 5 is a section of a brush formed according to an alternative embodiment.

Referring now to FIG. 5 there is shown a hand brush 301 having a handle portion 303 for painting formed according to an alternative embodiment.

In this embodiment the body portion 302 does not include a ferrule, but instead the head portion 304 has an internal rebate 306 into which a bristle cluster 307 is embedded.

In this embodiment the rebate 306 directly defines the set depth and forms a setting region 311 of 12 mm. The bristle cluster 307 comprises bristles of two different lengths: the longest bristles 309*f* have a length L6 and the shorter bristles 309*g* have a length L7. In this embodiment length L6 minus L7 is 6 mm. Accordingly, the range Y representing the difference between the length of the longest and shortest bristles is 6 mm and the set depth is 12 mm. The principles of the present invention in which the range must be less than the set depth are therefore satisfied. When the cluster 307 is embedded into the body portion 302 all of the bristles are within the setting region 311 to a lesser or greater extent. Further, although some of the shorter bristles 309*g* extend to the tip terminus point, many do not and the weight of the tip benefits accordingly.

Although only two different lengths of bristle are shown in FIG. 5 other embodiments in which three, four or more different bristles lengths are contained within the same cluster are not beyond the scope of the present invention as long as they satisfy the principles of the present invention when set into a handle.

The invention claimed is:

1. A paintbrush having a bristle cluster and a handle for holding the bristle cluster, the bristle cluster comprising bristles of two or more different lengths the ends of which are not all flush with one another at each end thereof, in which the difference in length between a longest bristle and a shortest bristle is not greater than a first length value, and one end of the bristle cluster being set into an adhesive composition without trimming the bristles at said one end of the bristle cluster to a penetration depth which is greater than the first length value.

2. A brush as claimed in claim 1, in which the difference in length between the longest bristle and the shortest bristle is not greater than the said first length value for substantially all of the bristles.

3. A brush as claimed in claim 1, in which the difference in length between the longest bristle and the shortest bristle is not greater than the said first length value for all of the bristles.

4. A brush as claimed in claim 1, in which the said first length value is less than one half of the said penetration depth.

5. A brush as claimed in claim 1, in which the bristle cluster comprises bristles of two different lengths.

6. A brush as claimed in claim 1, in which the said penetration depth value is approximately 12 mm.

7. A brush as claimed in claim 1, in which the said first length value is approximately 6 mm.

8. A brush as claimed in claim 1, in which the bristles comprise synthetic bristles.

9. A brush as claimed in claim 1, in which the bristles comprise natural bristles.

10. A brush as claimed in claim 1, in which the said adhesive composition is a resin.

11. A brush as claimed in claim 1, in which the brush has a ferrule and in which the bristle cluster is held by the ferrule.

12. A bristle cluster for a paint brush of the type having a handle for holding the bristles, in which one end of the cluster is set into the handle by embedding it in adhesive composition without trimming the bristles at said one end of the bristle cluster to a penetration depth having a penetration depth value, the cluster comprising bristles of two or more different lengths, in which the difference in length between a longest bristle and a shortest bristle is less than a first length value, in which the ends of the bristles are not flush with one another at either end, and in which the said first length value is less than the said penetration depth value.

13. A method of making a paintbrush comprising the steps of:

providing a bristle cluster comprising a plurality of bristles including bristles of two or more different lengths with the ends of the bristles not being flush with one another at each end thereof;

determining a difference in length between a longest bristle and a shortest bristle as being less than a first length value;

providing a handle for holding the bristle cluster with a bed of adhesive composition having a depth which is greater than said first length value; and setting one end of said bristle cluster without trimming said one end of said bristle cluster into said bed of adhesive composition in the handle by introducing said one end of said bristle cluster into said bed of adhesive composition by a penetration depth not less than said first length value.

* * * * *